US007089694B2

(12) United States Patent
Allen

(10) Patent No.: US 7,089,694 B2
(45) Date of Patent: Aug. 15, 2006

(54) SIGN POST ASSEMBLY AND METHOD FOR THE SAME

(75) Inventor: Todd Allen, Longdale, NV (US)

(73) Assignee: Entech, Inc., Longdale, NV (US)

( * ) Notice: Subject to any disclaimer, the term of this patent is extended or adjusted under 35 U.S.C. 154(b) by 0 days.

(21) Appl. No.: 10/877,803

(22) Filed: Jun. 24, 2004

(65) Prior Publication Data

US 2004/0262486 A1 Dec. 30, 2004

Related U.S. Application Data

(60) Provisional application No. 60/482,472, filed on Jun. 25, 2003.

(51) Int. Cl.
*G09F 15/00* (2006.01)

(52) U.S. Cl. ..... 40/607; 40/606; 40/607.04; 40/607.05; 40/607.06; 40/607.09; 248/530; 248/533; 248/545; 248/156; 173/91; 173/126

(58) Field of Classification Search ..... 248/156, 248/218.4, 507, 508, 530, 533, 545; 40/607.04, 40/607.05, 607.06, 607.09
See application file for complete search history.

(56) References Cited

U.S. PATENT DOCUMENTS 2,629,985 A 3/1953 McDowell
3,519,234 A 7/1970 Matson
3,712,389 A 1/1973 Smoak
4,065,085 A * 12/1977 Gellatly ..... 248/124.1
4,249,715 A 2/1981 Repp
4,261,424 A 4/1981 Gonterman et al.
4,279,104 A 7/1981 Classen
4,326,352 A 4/1982 Barth
4,343,449 A * 8/1982 Osthus ..... 248/156
4,378,650 A 4/1983 Ottoson
4,483,506 A 11/1984 Litwiller
4,524,533 A * 6/1985 Still, Jr. ..... 40/607.06
4,843,746 A * 7/1989 DesNoyers et al. ..... 40/607.04

(Continued)

OTHER PUBLICATIONS

Go Post! Internation, Inc. The Ultimate Real Estate Sign Post, http://www.gopostinc.com/residential.html, taken from site Aug. 7, 2003.

*Primary Examiner*—Robert P. Olszewski
*Assistant Examiner*—Todd M. Epps
(74) *Attorney, Agent, or Firm*—Thorpe North & Western LLP

(57) ABSTRACT

A method and apparatus providing a sign post assembly including a stabilizing post member, an outer tubular post and a horizontal post member. The stabilizing post member includes a spike portion and an inner post portion with a blocking portion coupled to the post member above the spike portion. The outer tubular post defines a post bore substantially extending through a length of the outer tubular post with at least a lower open end. The outer tubular post is configured to mate with the inner post portion to substantially extend within the post bore of the outer tubular post. The horizontal post member includes a horizontal post portion and a post coupling portion. The post coupling portion is configured to operatively couple with the inner post portion of the stabilizing post member so that the horizontal post portion extends transverse to the stabilizing post member to hang a sign thereto.

1 Claim, 6 Drawing Sheets

U.S. PATENT DOCUMENTS 4,856,423 A * 8/1989 Burns ..... 99/421 H
4,896,651 A * 1/1990 Kott, Jr. ..... 126/30
4,910,901 A * 3/1990 Boyar ..... 40/607.06
5,042,591 A * 8/1991 Hull ..... 173/91
5,086,849 A * 2/1992 Dahl ..... 173/126
5,375,801 A 12/1994 Porter
5,502,910 A 4/1996 Lucchesi
5,666,940 A * 9/1997 Kreiter ..... 126/30
5,768,785 A * 6/1998 Pessin ..... 30/164.6
5,833,181 A 11/1998 DesNoyers
2004/0065802 A1* 4/2004 Clasen ..... 248/530
2004/0206860 A1* 10/2004 Bolinder ..... 248/156

* cited by examiner

SIGN POST ASSEMBLY AND METHOD FOR THE SAME

Priority of application Ser. No. 60/482,472 filed Jun. 25, 2003 in the United States Patent and Trademark Office is hereby claimed.

BACKGROUND OF THE INVENTION

1. Field of the Invention

The present invention relates generally to real estate sign posts. More particularly, the present invention relates to a sign post assembly and a tool for installing and uninstalling the sign post assembly.

2. State of the Art

In recent years, the marketing and sale of homes and other single family dwellings have become increasingly competitive as major real estate brokerage firms have quickly expanded nationwide through franchising. As a result, the manner in which real estate is advertised has become increasingly important. As part of this new awareness and attention to marketing, real estate brokerages have designed and put into use distinctive, personalized styles of on-site property sale signs. By way of example, many nationwide chains currently utilize a distinctive wooden sign post assembly, the right-angle design and configuration of which is readily recognizable.

While such signs provide a marked improvement in construction and appearance over the more simplistic signs previously in widespread use, these new signs are significantly more expensive and cumbersome to use. Typically, the before-described signs are fabricated of conventional "four-by-four" wooden posts, including a vertical post member approximately four to six feet in height and a horizontal post member approximately two to three feet in length. Such wooden materials with their unique appearance are relatively expensive. Moreover, such signs are necessarily large, heavy and awkward to handle, to the point that such signs cannot be conveniently transported in an ordinary automobile and, in any event, an average real estate agent has difficult handling and erecting such signs. Consequently, real estate brokerage firms typically hire an independent contractor to erect and take down such signs on-site at property listed by the firm, which of course further increases the overall expense associated with the use of such signs.

U.S. Pat. No. 5,833,181, to DesNoyers, discloses an outdoor sign post assembly that overcomes many of the disadvantages of the above-mentioned sign posts of the prior art. However, such an outdoor sign post assembly has particular disadvantages, in which the DesNoyers reference discloses a relatively short anchor member for supporting the sign post assembly. While such anchor member may support the sign post assembly in some conditions, often the sign post is assembled in wet ground conditions, often resulting in insufficient support to the sign assembly. This can especially be a problem for sign posts assembled in areas prone to jarring by, for example, lawn mowers and playing children. Such problem is further exacerbated by the type of materials the sign assembly is made from, specifically, light-weight plastic tubing. The light-weight plastic tubing can crack and break from being jarred and often will not weather well when exposed to outside weather conditions. Furthermore, in conditions where the ground is hardened or is frozen, the anchor member disclosed in the DesNoyers reference will cause problems for many of the average real estate agents to sufficiently drive such anchor member into the ground.

SUMMARY OF THE INVENTION

The present invention relates to a method and apparatus providing a sign post assembly. The sign post assembly includes a stabilizing post member, an outer tubular post and a horizontal post member. The stabilizing post member includes a spike portion and an inner post portion with a blocking portion fixedly coupled to an outer surface of the stabilizing post member above the spike portion. The outer tubular post defines a post bore substantially extending through a length of the outer tubular post with at least a lower open end. The outer tubular post is configured to mate with the inner post portion to substantially extend within the post bore of the outer tubular post. The horizontal post member includes a horizontal post portion and a post coupling portion. The post coupling portion includes a tubular portion integrally formed transverse with the horizontal post portion and is configured to operatively couple with the inner post portion of the stabilizing post member. The horizontal post portion is configured to extend substantially laterally with respect to the stabilizing post member and is configured to hang a sign thereto.

In another embodiment, the present invention includes a tool configured to assist in assembly and disassembly of the sign post in the ground. The tool can include a slide hammer having a tubular hammer portion. The tubular hammer portion defines a hammer bore with opposite open ends and can include handles extending from the tubular hammer portion. The slide hammer is configured to receive the inner post portion through the hammer bore of the tubular hammer portion and is configured to be longitudinally reciprocated along the inner post portion against the blocking portion of the stabilizing post member to pound the spike portion into the ground and then be removed from the sign post assembly.

In another embodiment, the tool can include a blocking pin configured to be inserted through an inner post opening defined through an upper portion of the inner post portion so that opposing ends of the blocking pin extend laterally from the inner post portion. The slide hammer is configured to be reciprocated along the inner post portion against the blocking pin until the spike portion of the stabilizing post member is dislodged from the ground.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

FIG. 3(*a*) illustrates a cross-sectional view of another embodiment of the spike portion;

FIG. 4(*a*) illustrates a cross-sectional view of another embodiment of an inner post portion coupled to the tubular coupling portion;

FIG. 5(*a*) illustrates a cross-sectional view of another embodiment of an upstanding coupling portion coupled to the tubular coupling portion;

DETAILED DESCRIPTION

Figure 1:
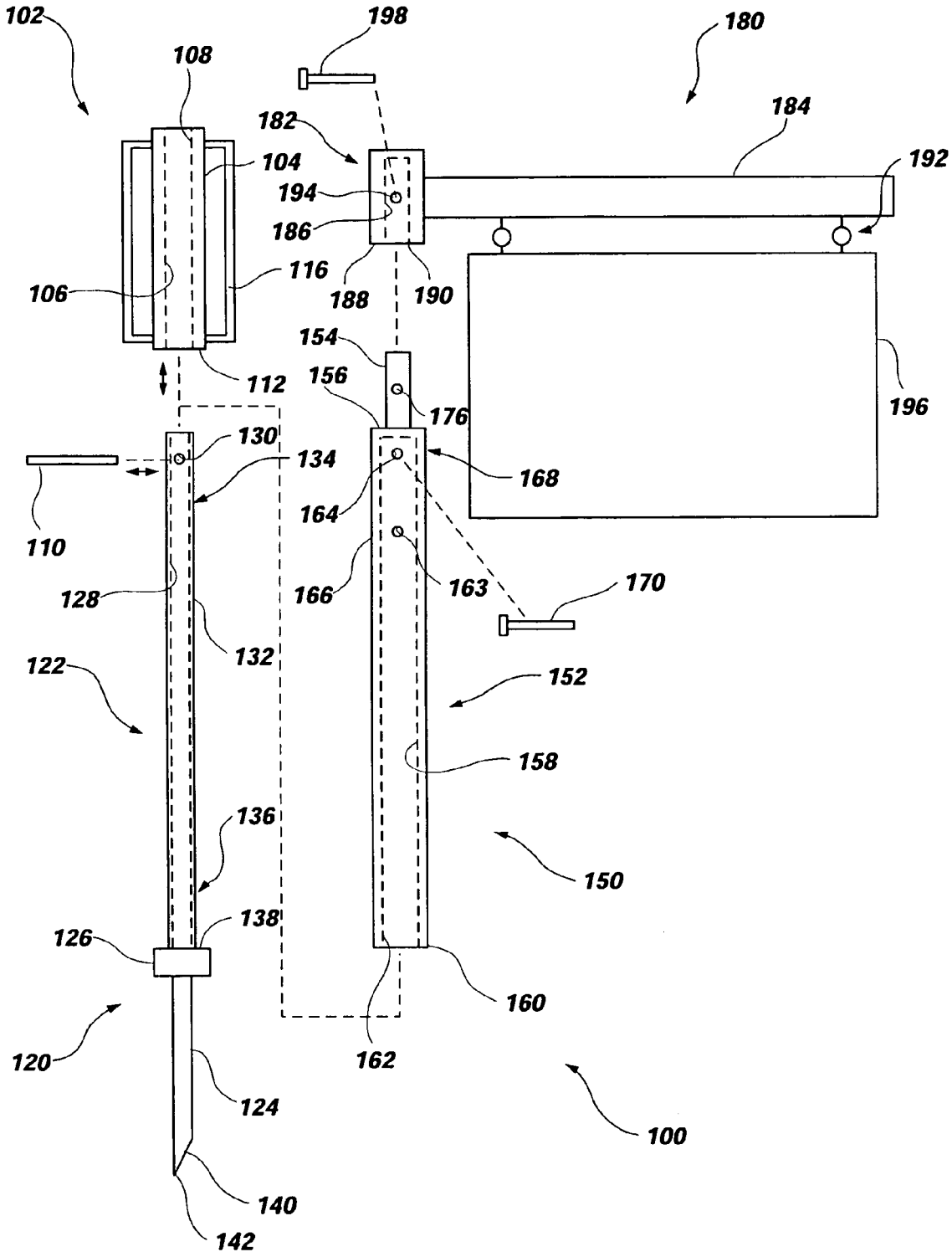
FIG. 1 illustrates an exploded view of a sign post assembly, depicting the sign assembly including a stabilizing post member, an upright outer post member and a horizontal post member and a slide hammer used for anchoring the stabilizing post member, according to an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
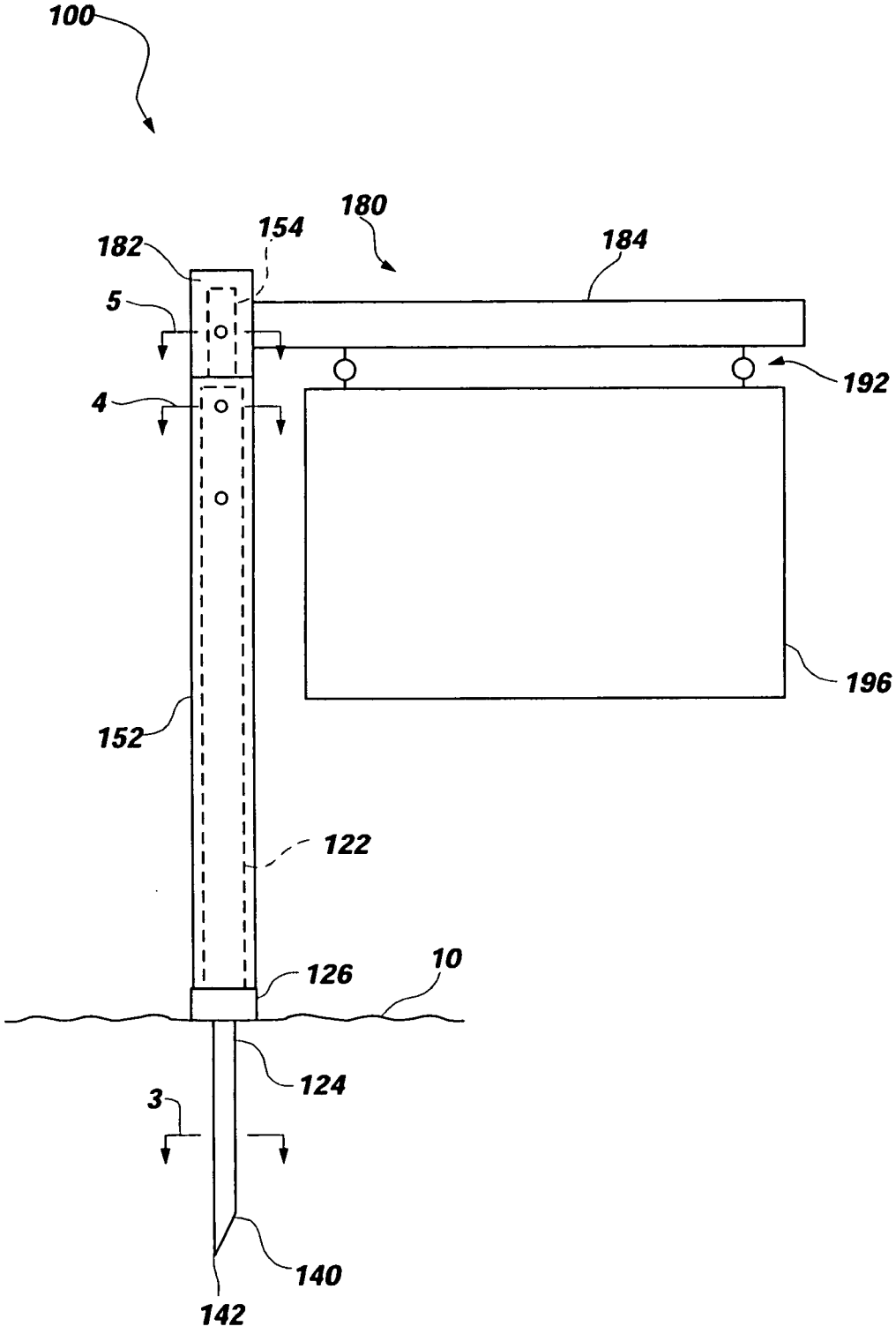
FIG. 2 illustrates the sign post assembled in the ground.

FIGS. 1 and 2 illustrate a sign post assembly 100 of the type for temporarily placing in the ground 10 for advertising and/or marketing real estate that is for sale. Such a sign post assembly 100 includes a tool and, in particular, a slide hammer 102 used to lodge and anchor a stabilizing post member 120 into the ground; and, upon disassembling the sign post assembly 100, the slide hammer 102 is used in conjunction with a blocking pin 110 to dislodge the stabilizing post member 120 from the ground 10. The sign post assembly 100 can include, among other things, the stabilizing post member 120, an upright outer post member 150 and a horizontal post member 180.

Each of the components of the sign post assembly 100 can be formed at least partially from a tubular metallic material, such as aluminum, steel and/or alloys thereof, or any other suitable material known to one of ordinary skill in the art that is relatively light due to being tubular, but is also durable to withstand years of repeated use. The upright outer post member 150 and the horizontal post member 180 can receive a powder coated finish to withstand exposure to the elements. It is also contemplated that the upright outer post member 150 and the horizontal post member 180 can be made from a polymeric material and/or a vinyl material, while the stabilizing post member is formed from a metallic material.

The slide hammer 102 is configured to anchor and dislodge the stabilizing post member 120 to and from the ground 10. Such a slide hammer 102 can include a weighted-down tubular hammer portion 104 defining a hammer bore 106 extending longitudinally through the tubular hammer portion 104 with opposite open ends. Also, the tubular hammer portion 104 can include handles 116 extending from the tubular hammer portion to facilitate manually reciprocating the slide hammer 102, described in further detail herein. The slide hammer 102 can be formed from a heavy, high-strength steel or an alloy thereof, or any suitable material known to one of ordinary skill in the art.

The stabilizing post member 120 is an elongated upstanding post configured to stabilize the remaining components of the sign assembly 100. Such a stabilizing post member can include an inner post portion 122 disposed above a spike portion 124 with a blocking portion 126 fixedly coupled to an outer surface above the spike portion 124. The stabilizing post member 120 is configured to be anchored or lodged in the ground 10 with the inner post portion 122 configured to upwardly stand above the ground 10. The inner post portion 122 can be, but is not limited thereto, a tubular structure with an inner bore 128 extending through a length of the inner post portion 122 between opposite upper and lower ends thereof. The inner post portion 122 can include an inner post opening 130 extending substantially laterally orthogonal through opposing side walls 132 of the inner post portion 122 at an upper end portion 134 thereof. Such an inner post opening 130 can be sized and configured to receive a blocking pin 110 for facilitating removal of the stabilizing post member 120, described in further detail herein. Also, the inner post opening 130 can be sized and configured to receive a pin member 170, such as a bolt, for coupling the stabilizing post member 120 to the upright outer post member 150. As such, the inner post opening 130 is positioned at the upper end portion 134 thereof to facilitate duel functions for the removal of the stabilizing post member 120 and for coupling the sign post assembly 100 together.

The blocking portion 126 can be a collar or flange coupled to and around a lower end portion 136 of the inner post portion 122. The blocking portion 126 is configured to facilitate pounding the stabilizing post member 120 into the ground with the slide hammer 102. Such a blocking portion 126 can be fixed to the lower end portion 136 by welding or any other suitable method of coupling thereto, such as with fasteners. It is important that the blocking portion 126 include structure with a pounding surface 138 that is substantially orthogonal with respect to the longitudinal length of the inner post portion 122. The blocking portion 126 can be formed of high strength steel, or an alloy thereof, or any other suitable material that can withstand the pounding of the slide hammer 102. Furthermore, the blocking portion 126 can act as a guage for identifying the depth the spike portion 124 has bee driven in the ground. Typically, a suitable depth for the spike portion 124 can result in the blocking portion 126 being disposed at approximately ground level.

The spike portion 124 can be coupled to the lower end of the inner post portion 122. It is also contemplated that the spike portion 124 can be coupled to the blocking portion 126 and/or be an integral extension of the inner post portion 122. The spike portion 124 can extend approximately 12 inches to 30 inches below the blocking portion 126 and can be formed of high strength steel, or an alloy thereof, or any other suitable material known to one of ordinary skill in the art.

Figure 3:
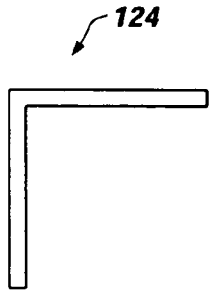
FIG. 3 illustrates a cross-sectional view of a spike portion of the stabilizing post member taken along line 3 in FIG. 2.
Figure 3A:
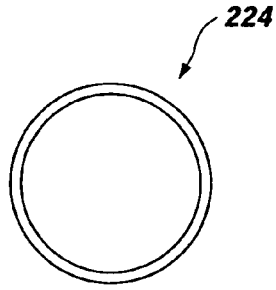

The spike portion 124 can include a tapered portion 140 tapering toward a free end 142 of the spike portion 124, which is configured to be a ground impaling member that can be readily driven into the ground 10. The spike portion 124 can be formed of, for example, angle iron having an L-shaped cross-section, as illustrated in FIG. 3. In another embodiment, a spike portion 224 can also be formed of a tubular member having a circular cross-section, as depicted in FIG. 3(*a*). As can be well appreciated by one of ordinary skill in the art, there are many suitable configurations for the spike portion, such as a square cross-section with a tapered end portion, a solid rod with a tapered end portion, or any other suitable configuration that facilitates penetrating the ground.

Referring again to FIGS. 1 and 2, the upright outer post member 150 can include an outer tubular portion 152 and an upstanding coupling portion 154. The outer tubular portion 152 can define a post bore 158 substantially extending a length of the outer tubular portion 152 with at least a lower end 160 thereof being an open end 162. The upstanding coupling portion 154 can be configured to be integrally formed and extend longitudinally upward from a top end 156 of the outer tubular portion 152. Such a top end 156 can be caped with the upstanding coupling portion 154 extending therefrom or the upstanding coupling portion 154 can be formed with an integral lateral extension extending inward at the top end 156 and then upward to form such upstanding coupling portion 154.

The outer tubular portion 152 is elongated and extends at least the length, but preferably slightly longer, than the length of the inner post portion 122 of the stabilizing post member 120. The outer tubular portion 152 can define an outer post opening 164 substantially extending laterally orthogonal through opposite side walls 166 of the outer tubular portion 152. Such an outer post opening 164 can be located, but is not limited to, an upper end portion 168 of the outer tubular portion 152. Further, there can be additional outer post openings 163 along the length thereof to adjust the height of the sign post assembly 100. With this arrangement, the outer tubular portion 152 is configured to mate with the inner post portion 122 of the stabilizing post member 120 in a freely sliding manner. That is, the outer tubular portion 152 is configured to receive the inner post portion 122 through the post bore 158 so that the outer tubular portion 152 freely slides downward and is disposed around the inner post portion 122. As such, the inner post portion can be configured to substantially extend within the post bore 158 of the outer tubular portion 152. Substantially extending within the post bore 158 can be defined to be at least ⅔ the length of the post bore and/or the length of the outer tubular portion 152, but is preferably substantially the entire length of the post bore defined in the outer tubular portion 152. The inner post portion can be, but is not limited to, approximately 3 feet to 5 feet in length.

As can be well appreciated by one of ordinary skill in the art, the sign post assembly will be sufficiently stabilized by the stabilizing post member 120 by extending the inner post portion 122 within the post bore 158 to substantially extend therein as previously described. Further, it is important that the inner post portion 122 have sufficient length for the space needed to reciprocate the slide hammer 102 therealong for pounding the spike portion 124 into the ground 10 as well as dislodging the spike portion 124 from the ground 10, as will be further described herein.

Figure 4:
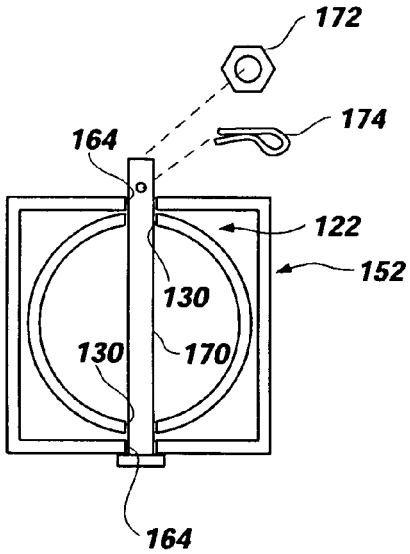
FIG. 4 illustrates a cross-sectional view of the stabilizing post member and the upright outer post member taken along line 4 in FIG. 2, depicting an inner post portion coupled to an outer tubular portion, according to an embodiment of the present invention.
Figure 4A:
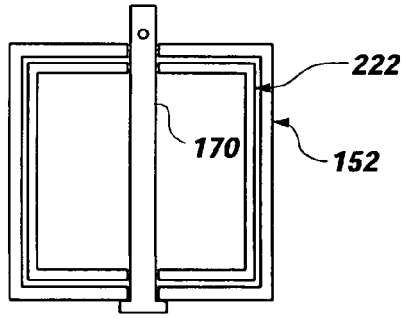

With respect to FIG. 4, with the outer tubular portion 152 disposed around the inner post portion 122, the outer post opening 164 defined in the outer tubular portion 152 can be aligned with the inner post opening 130 defined in the inner post portion 122. Once aligned, the before-mentioned pin member 170, such as a bolt, can be placed through the outer and inner post openings 164 and 130 to provide a coupling arrangement between the upright outer post member 150 and the stabilizing post member 120. Such a pin member 170 can then be locked into position with a nut 172 or cotter pin 174 or any other suitable fastening and/or locking arrangement. It is also contemplated that other suitable coupling means can be implemented, such as detent buttons and the like, or any other suitable coupling arrangement known to one of ordinary skill in the art. As depicted, the inner post portion 122 can be tubular with a circular configuration or cross-section. The pin member 170 coupling the inner post portion 122 to the outer tubular portion 152 stabilizes the upright outer post member 150 from being freely rotated about the stabilizing post member 120, to thereby provide stabilization to a specific position. Further, the pin member 170 can also act to suspend the outer tubular portion 152 to the inner post portion 122.

FIG. 4(*a*) illustrates another embodiment of an inner post portion 222. In this embodiment, the inner post portion 222 can include a square configuration or cross-section. Such a square configuration inherently maintains the outer tubular portion 152 with a desired orientation by preventing rotation of the outer tubular portion 152 about the inner post portion 222. As such, in this embodiment, the pin member 170 can be utilized to deter unauthorized disassembly and removal of the upright outer post member 150 from the stabilizing post member 120 and/or suspend the outer tubular portion 152 to the inner post portion 122.

Referring again to FIGS. 1, 2 and 5, the horizontal post member 180 can include a post coupling portion or tubular coupling portion 182 and a horizontal post portion 184. Such a tubular coupling portion 182 can be integrally formed with the horizontal post portion 184 and formed with a transverse orientation with respect to the horizontal post portion 184. The tubular coupling portion 182 can define a cavity 186 with a lower end 188 of the tubular coupling portion 182 defining a cavity opening 190. Such a cavity opening 190 is sized and configured to receive the upstanding coupling portion 154 to couple the horizontal post member 180 to the upright outer post member 150 to, thereby operatively couple the horizontal post member 180 to the inner post portion 122.

Figure 5:
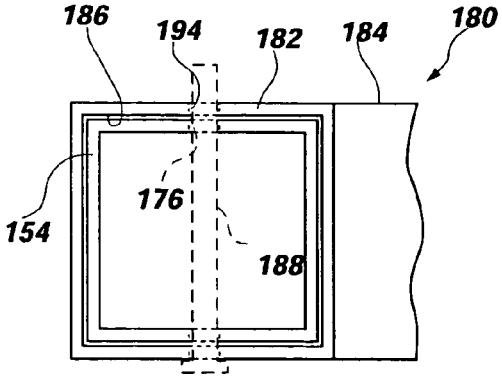
FIG. 5 illustrates a cross-sectional view of the upright outer post member and the horizontal post member taken along line 5 in FIG. 2, depicting an upstanding coupling portion coupled to a tubular coupling portion, according to an embodiment of the present invention.
Figure 5A:
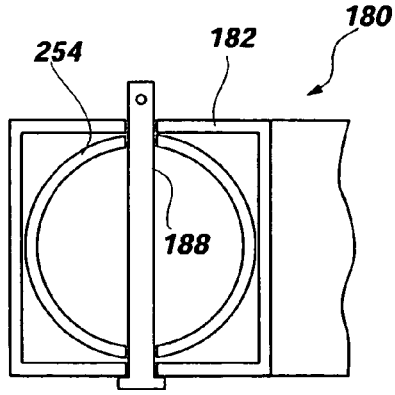
Figure 6:
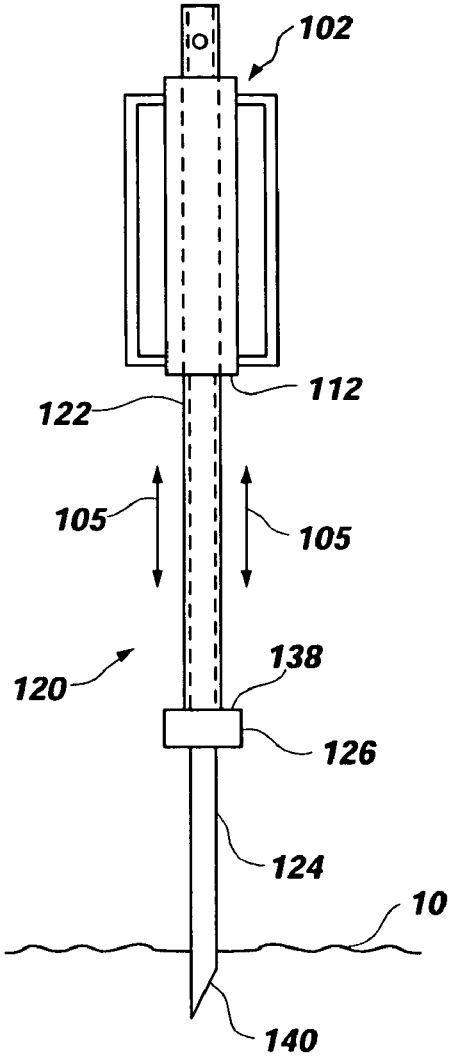
FIG. 6 illustrates a front view of the stabilizing post member and the slide hammer, depicting a method of anchoring the stabilizing post member with the slide hammer.

As depicted in FIG. 5, the tubular coupling portion 182 and the upstanding coupling portion 154 can each include a tubular, square configuration sized and configured so that the tubular coupling portion 182 maintains its orientation and cannot rotate about the upstanding coupling portion 154. As indicated in outline, in one embodiment, the upstanding coupling portion 154 and the tubular coupling portion 182 can each include respective openings 176 and 194 configured to correspond and align with each other and configured to receive a pin 198 to deter unauthorized removal of the horizontal post member 180 from the upright outer post member 150. As well known to one of ordinary skill in the art, other suitable coupling means can be utilized other than a pin, such as detent buttons and the like. In another embodiment, the upstanding coupling portion 254 can include a tubular, circular cross-section, as depicted in FIG. 5(*a*), in which case a pin 198 can be provided to be inserted through corresponding and aligned openings extending through the upstanding coupling portion 254 and the tubular coupling portion 182 to prevent rotation of the horizontal post member 180 as well as deter theft and/or unauthorized disassembly. It is also contemplated that other means for coupling can be utilized With reference again to FIGS. 1 and 2, the horizontal post portion 184 of the horizontal post member 180 can substantially extend laterally and, preferably, substantially orthogonal from the tubular coupling portion 182. The horizontal post portion 184 can be an elongated, tubular structure with a square or circular cross-section. Such horizontal post portion 184 can be made from a metallic material, preferably steel or an alloy thereof, and can be welded to the tubular coupling portion 182. The horizontal post portion 184 is configured to hold and/or freely hang a sign 196 therefrom with couplings 192 therebetween.

Referring now to FIGS. 1, 2, 6 and 7, assembly and disassembly of the sign post assembly 100 will now be described. Initially, a desired position on the ground 10 is identified for anchoring the stabilizing post member 120. Once the desired position is found, the upper end portion 134 of the inner post portion 122 can be inserted through the hammer bore 106 of the slide hammer 102 to let such slide hammer slide down against the blocking portion 126. The stabilizing post member 120 can then be uprightly positioned with the spike portion 124 pointed into the surface of the ground 10. As indicated by bi-linear arrows 105 depicted in FIG. 6, the slide hammer 102 can then be manually reciprocated up and down, thrusting downward on the down stroke to pound a bottom surface 112 of the slide hammer 102 against the upper pounding surface 138 of the blocking portion 126, thereby, initially forcing the tapered portion 140 into the ground and eventually the entire spike portion 124 into the ground 10. Once the spike portion 124 is fully positioned in the ground 10 in an unexposed and sufficiently stable manner, the slide hammer 102 can be removed from the inner post portion 122 to assemble the remaining components of the sign post assembly 100 to the stabilizing post member 120.

With reference to FIGS. 1 and 2, the upright outer post member 150 can then be positioned above the stabilizing post member 120 so that the inner post portion 122 is received within the post bore 158 of the outer tubular portion 152. The outer post opening 164 can then be aligned with the inner post opening 130, after which, a pin member 170 can be inserted through the aligned outer and inner post openings 164 and 130 to couple the upright outer post member 150 to the stabilizing post member 120 and provide stabilization thereto. The tubular coupling portion 182 of the horizontal post member 180 can then be positioned over the upstanding coupling portion 154 so that such upstanding coupling portion 154 is received into the cavity 186 of the tubular coupling portion 182 of the horizontal post member 180. If desired or needed, a pin 198 can be inserted through corresponding openings defined in each of the tubular coupling portion 182 and the upstanding coupling portion 154 to secure the coupling between the horizontal post member 180 and the upright outer post member 150. In this manner, the sign post assembly 100 can be assembled with the stabilizing post member 120 anchored in the ground with the slide hammer 102.

Figure 7:
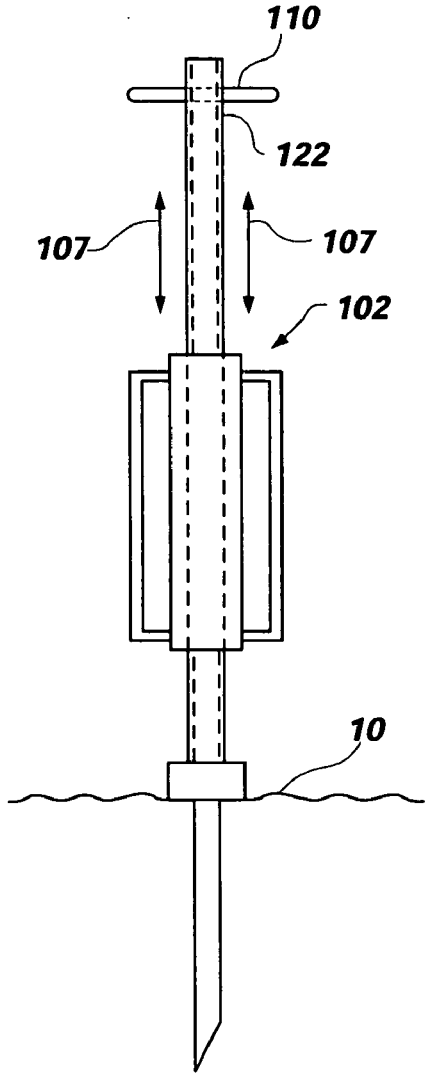
FIG. 7 illustrates a side view of the stabilizing post member and the slide hammer, depicting a method of dislodging the stabilizing post member with the slide hammer.

With respect to FIGS. 1 and 7, the slide hammer 102 can also be utilized when disassembling the sign post assembly 100. Disassembly can be implemented by removing any pin members, such as the pin member 170 coupling the upright outer post member 150 to the stabilizing post member 120 and/or the pin 198 securing the horizontal post member 180 to the upright outer post member 150. The horizontal post member 180 can then be lifted upward from the upstanding coupling portion 154, after which, the upright outer post member 150 can be lifted upward from the inner post portion 122. The slide hammer 102 can then be positioned over the inner post portion 122 so that such inner post portion 122 is received through the hammer bore 106 and slid downward to the blocking portion 126 of the stabilizing post member 120. A blocking pin 110 can then be inserted through the inner post opening 130 of the inner post portion 122 so that the opposite ends 114 of the blocking pin 110 extend laterally orthogonal from opposite side walls 132 of the inner post portion 122. As indicated by arrows 107 depicted in FIG. 7, the slide hammer 102 can then be manually reciprocated up and down, thrusting upward on the up stroke against the blocking pin 110 until the spike portion 124 of the stabilizing post member 120 is dislodged from the ground 10. In this manner, the sign post assembly 100 can be readily disassembled utilizing the slide hammer 102 and the blocking pin 110 to dislodge the stabilizing post member 120 from the ground 10.

Figure 8:
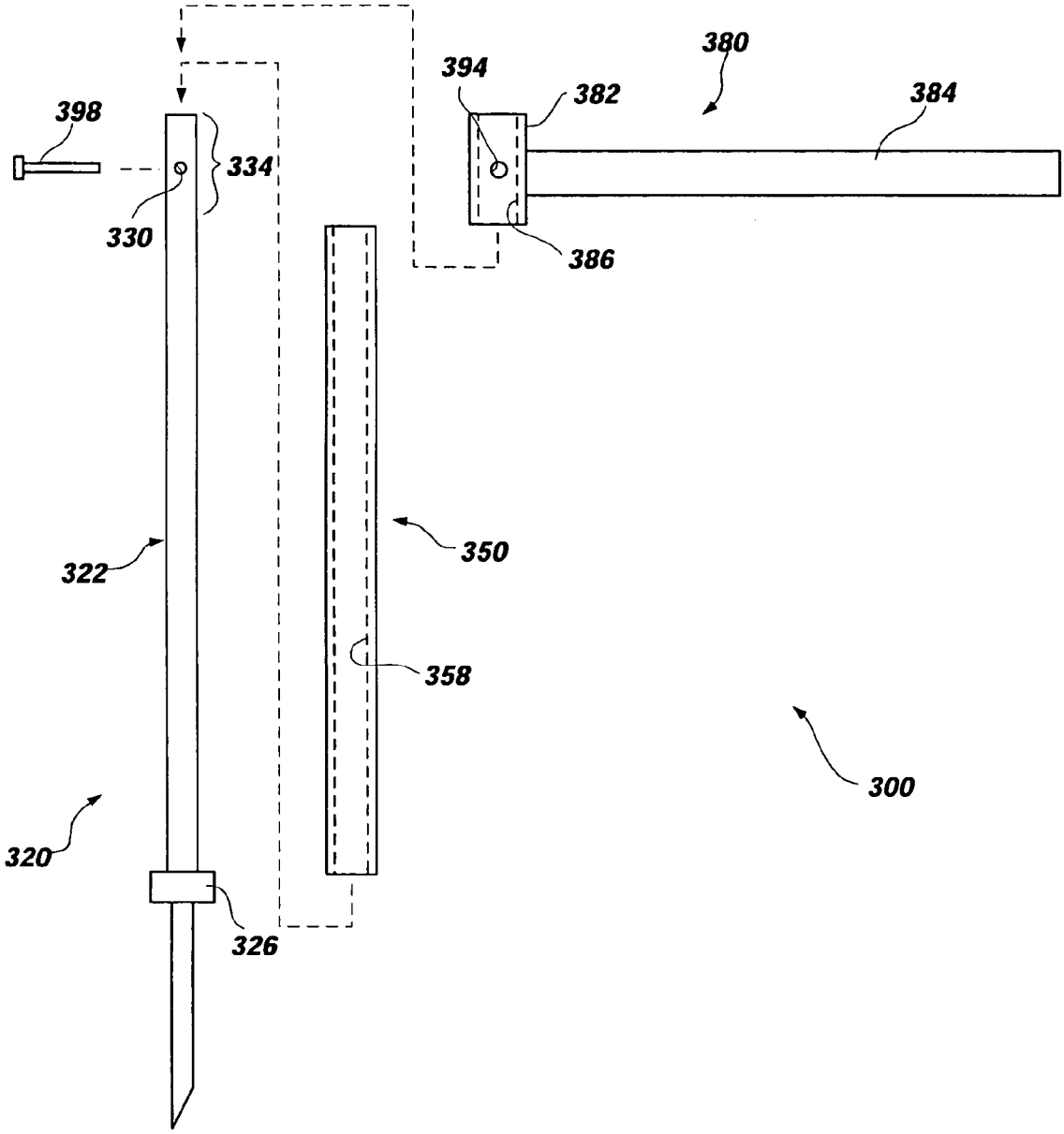
FIG. 8 illustrates an exploded view of another embodiment of a sign post assembly, depicting the inner post portion of the stabilizing post member configured to extend through the outer tubular post and a tubular coupling portion of the horizontal post member configured to be coupled to an upper portion of the inner post portion.

With reference now to FIG. 8, another embodiment of a sign post assembly 300 is illustrated. This embodiment of the assembly 300 is substantially similar to the previous embodiment with the stabilizing post member 320 and the horizontal post member 380, except this embodiment can include an outer tubular post 350 having a post bore 358 extending longitudinally therethrough with opposite open ends. Such an outer tubular post 350 is sized and configured to receive the inner post portion 322 through the post bore 358 so that a lower end of the outer tubular post 350 can be positioned on the blocking portion 326 of the stabilizing post member 320. The inner post portion 322 of the stabilizing post member 320 includes a length longer than the outer tubular post 350 so that an upper portion 334 of the inner post portion 322 is temporarily exposed and extends above the outer tubular post 350. As such, the cavity 386 defined by the post coupling portion or tubular coupling portion 382 of the horizontal post member 380 can receive the upper portion 334 of the inner post portion 322 for coupling thereto. As in the previous embodiment, the tubular coupling portion 382 can be integrally formed transverse with the horizontal post portion 384. Also, the tubular coupling portion 382 can include an outer post opening 394 extending laterally therethrough that can be aligned with an inner post opening 330 extending laterally through the inner post portion 322 to receive a pin 398 for coupling the horizontal post member 380 to the inner post portion 322 of the stabilizing post member 320.

Figure 9:
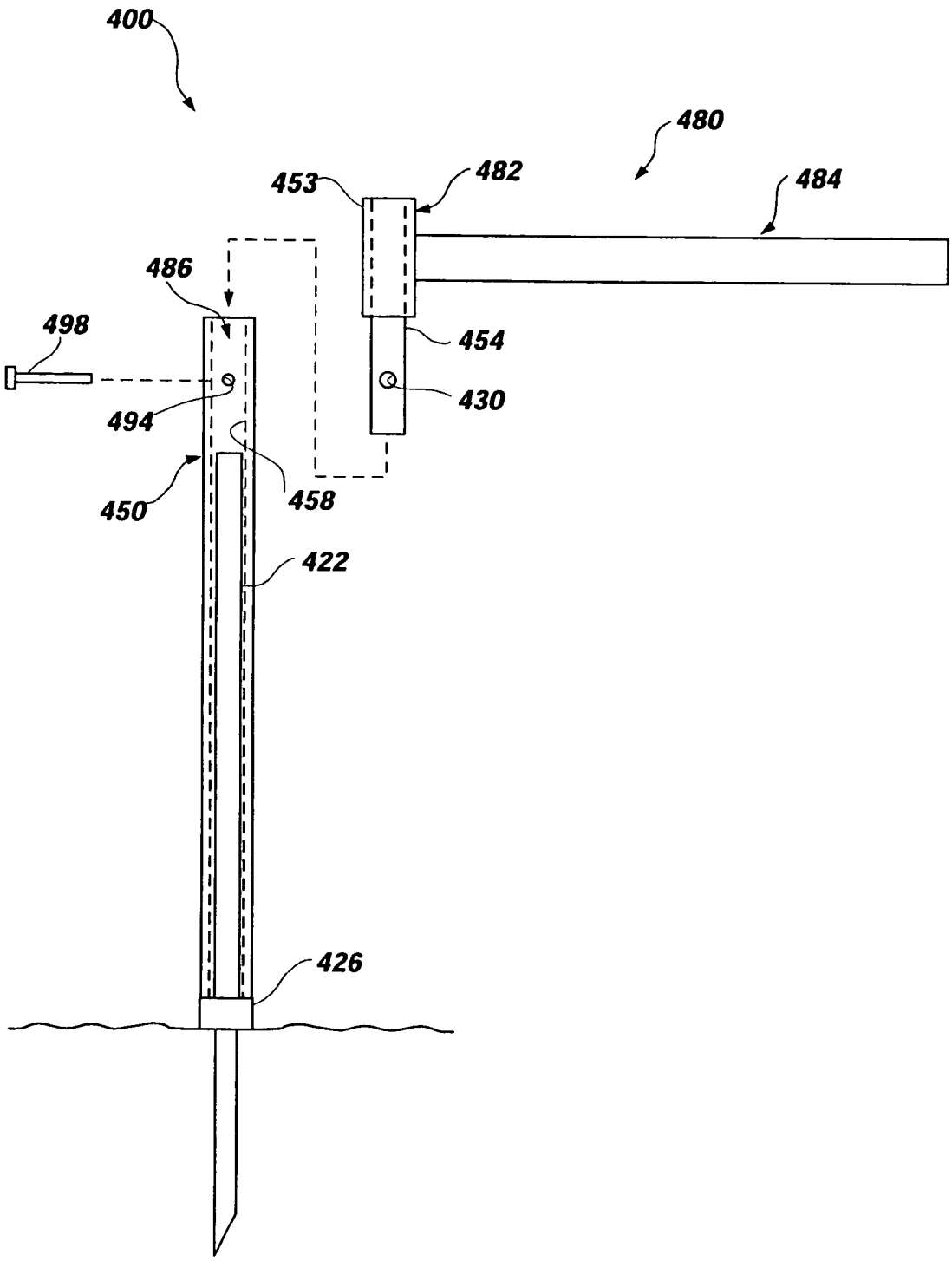
FIG. 9 illustrates a partially exploded view of another embodiment of the sign post assembly, depicting the tubular coupling portion having a downward tubular extension configured to be disposed in the upper portion of the outer tubular post and configured to be coupled thereto.

With reference to FIG. 9, another embodiment of a sign post assembly 400 is illustrated. As in the previous embodiment, the outer tubular post 450 can include the post bore 458 extending longitudinally therethrough with opposite open ends. In this embodiment, the inner post portion 422 of the stabilizing post member 420 can include a smaller length than the outer tubular post 450. As such, with the inner post portion 422 inserted through and positioned within the post bore 458 of the outer tubular post 450 so that the lower end of the outer tubular post 450 rests on the blocking portion 426 of the stabilizing post member 420, the outer tubular post 450 extends above the inner post portion 422 to define a cavity 486. The cavity 486, defined by the upper portion of the outer tubular post 450, is sized and configured to receive a post coupling portion or tubular coupling portion 482 integrally formed transverse with the horizontal post portion 484 of the horizontal post member 480. In particular, the tubular coupling portion 482 can include an exposed tubular portion 453 and a downward tubular extension 454 extending substantially longitudinally downward from the exposed tubular portion 453. Such a downward tubular extension 454 is sized and configured to matingly fit within the upper portion of the outer tubular post 450 or cavity 486. Also, such downward tubular extension 454 can include an inner post opening 430 extending laterally therethrough that can be aligned with an outer post opening 494 extending laterally through the outer tubular portion 450 to receive a pin 498 for coupling the horizontal post member 480 to the outer tubular post 450, thereby operatively coupling the horizontal post member 480 to the inner post portion 422 of the stabilizing post member 420.

As can be well appreciated by one of ordinary skill in the art, the sign post assembly of the present invention breaks-down into manageable components sized for readily placing in a trunk of a car, and further, is sized for placing several sign post assemblies within the trunk of a car. Likewise, due to the manageable components of the sign post assembly, mass transportation of such components is cost effective and efficient. Further, the stabilizing post member is configured to readily anchor and stabilize the other components of the sign post assembly. Also, the slide hammer and blocking pin provide a simple tool for readily anchoring the stabilizing post member in the ground as well as dislodging the stabilizing post member from the ground without having to dig a hole and substantially scarring the ground. Additionally, the sign post assembly is such that a single slide hammer and blocking pin can be utilized for anchoring and dislodging a multitude of sign post assemblies, thereby, limiting the cost required from a manufacturing stand point as well as limiting the cost to the end user.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the examples.

The invention claimed is:

1. A method of assembling a sign post assembly in the ground and removal therefrom, the method comprising:

inserting a top end of an inner post portion of a stabilizing post member through a tubular hammer portion of a slide hammer;

positioning a spike portion of the stabilizing post member to sit upright on the ground with the inner post portion disposed above the ground;

reciprocating the slide hammer disposed around the inner post portion against a blocking portion fixedly coupled to an outer surface of the stabilizing post member above the spike portion to pound the spike portion into the ground until the spike portion is unexposed;

removing the slide hammer from the top end of the inner post portion of the stabilizing post member;

mating an outer tubular post with the inner post portion so that the inner post portion is disposed within a post bore, defined in the outer tubular post extending substantially a length thereof, with the inner post portion substantially extending within the post bore of the outer tubular post;

operatively coupling a post coupling portion of a horizontal post member with the inner post portion of the stabilizing post member, the post coupling portion including a tubular portion integrally formed transverse with the horizontal post member;

removing the horizontal post member and the outer tubular post;

re-inserting the top end of the inner post portion of the stabilizing post member through the tubular hammer portion of the slide hammer;

inserting a blocking pin through an inner post opening extending through the inner post portion formed at an upper portion thereof so that opposing ends of the blocking pin extend laterally from the inner post portion; and reciprocating the slide hammer disposed around the inner post portion against the blocking pin until the spike portion of the stabilizing post member is dislodged from the ground.

* * * * *